US005089752A

United States Patent [19]

Pacholok

[11] Patent Number: 5,089,752

[45] Date of Patent: Feb. 18, 1992

[54] HIGH FREQUENCY LUMINOUS TUBE POWER SUPPLY WITH GROUND FAULT PROTECTION

[75] Inventor: David Pacholok, Sleepy Hollow, Ill.

[73] Assignee: Everbrite, Inc., Greenfield, Wis.

[21] Appl. No.: 590,652

[22] Filed: Sep. 28, 1990

[51] Int. Cl.[5] ..... H05B 41/36

[52] U.S. Cl. ..... 315/307; 315/224; 315/225

[58] Field of Search ..... 315/307, 308, 224, 225, 315/DIG. 7

[56] References Cited

U.S. PATENT DOCUMENTS

| | | | |
|---|---|---|---|
| Re. 32,904 | 4/1989 | Pacholok | 315/DIG. 7 |
| 3,435,320 | 3/1969 | Lee et al. | 331/112 |
| 3,909,747 | 9/1975 | Beierholm | 331/112 |
| 3,925,717 | 12/1975 | Kinnard | 331/112 |
| 3,964,487 | 6/1976 | Judson | 331/112 |
| 3,989,995 | 11/1976 | Peterson | 331/112 |
| 4,005,335 | 1/1977 | Perper | 315/224 |
| 4,056,734 | 11/1977 | Peterson | 307/254 |
| 4,084,219 | 4/1978 | Furukawa | 331/112 |
| 4,172,276 | 10/1979 | Kameya | 363/19 |
| 4,228,382 | 10/1980 | Virtanen | 315/219 |
| 4,283,759 | 8/1981 | Koiki | 363/19 |
| 4,286,194 | 8/1981 | Sherman | 315/209 R |
| 4,363,005 | 12/1982 | Kuroda | 331/112 |
| 4,378,585 | 3/1983 | Bete | 331/112 |
| 4,385,347 | 5/1983 | Takematsu | 363/49 |
| 4,388,562 | 6/1983 | Josephson | 315/205 |
| 4,388,563 | 6/1983 | Hyltin | 315/205 |
| 4,420,804 | 12/1983 | Nishino | 363/21 |
| 4,441,087 | 4/1984 | Nilssen | 331/113 |
| 4,443,839 | 4/1984 | Onodera | 331/112 |
| 4,481,564 | 11/1984 | Balaban | 363/21 |
| 4,484,108 | 11/1984 | Stupp | 315/219 |
| 4,486,822 | 12/1984 | Marinus | 363/19 |
| 4,504,775 | 3/1985 | Becker | 363/19 |
| 4,559,478 | 12/1985 | Fuller et al. | 315/224 |
| 4,587,461 | 5/1986 | Hanlet | 315/224 |
| 4,613,934 | 9/1986 | Pacholok | 315/DIG. 7 |
| 4,654,771 | 3/1987 | Stasch et al. | 363/19 |
| 4,654,772 | 3/1987 | Thorne | 363/19 |
| 4,698,741 | 10/1987 | Pacholok | 363/131 |
| 4,716,343 | 12/1987 | Lindquist | 315/307 |
| 4,855,860 | 8/1989 | Nilssen | 315/307 |
| 4,904,903 | 2/1990 | Pacholok | 315/209 R |
| 4,928,037 | 5/1990 | Kawabata et al. | 315/225 |
| 4,958,109 | 9/1990 | Naum | 315/307 |
| 4,999,546 | 3/1991 | Koda et al. | 315/307 |

*Primary Examiner*—Eugene R. LaRoche
*Assistant Examiner*—Tan Dinh
*Attorney, Agent, or Firm*—Maksymonko & Slater

[57] ABSTRACT

A high frequency PWM power supply for luminous tubes including a low power constant frequency, uniform pulse width generator which charges the intrinsic input capacitance of an insulated junction power FET thereby switching a source of DC voltage across the primary of a high voltage transformer. A current sense resistor and load current compensator discharge the FET gate capacitance upon attaining a predetermined average luminous tube load current. The secondary power supply output includes a series capacitance to minimize tube end discoloration particularly prevalent in mercury luminous tubes. A ground fault detector employing the intrinsic secondary capacitance and transformer core with a dual-peak detector thereby providing enhanced accuracy and ground fault reliability.

8 Claims, 2 Drawing Sheets

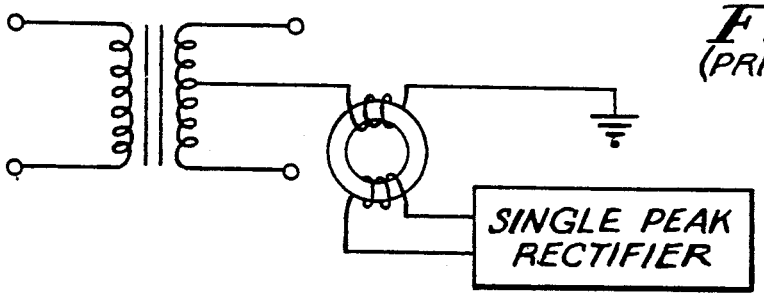
FIG. 4
(PRIOR ART)
FIG. 5
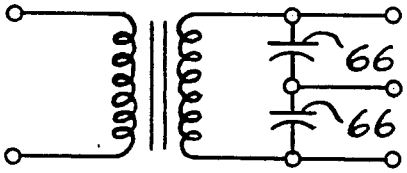
FIG. 6
WITH AVERAGING
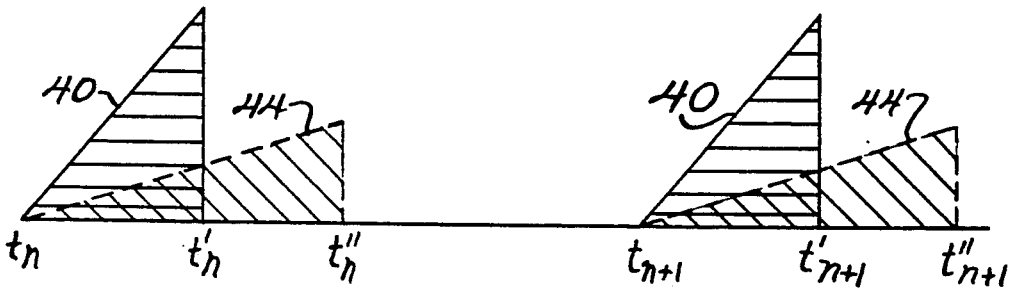
FIG. 7
WITHOUT AVERAGING
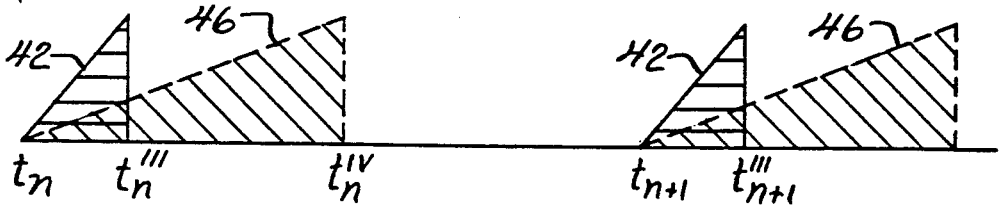

HIGH FREQUENCY LUMINOUS TUBE POWER SUPPLY WITH GROUND FAULT PROTECTION

BACKGROUND OF THE INVENTION

The present invention relates to high frequency power supplies for use with luminous, e.g. neon, tubular glass signage of the type often found in connection with retail advertising and decorating. As outlined hereinafter, the present supply overcomes several problems endemic to this class of luminous tube power sources and, importantly, does so in a most efficacious, reliable, and cost effective manner. In this latter connection it will be appreciated that luminous tube supplies are used in large quantities and consequently any per-unit cost savings will have a profound impact on commercial viability and product profitability.

In the first instance, the present supply is generally of the non-resonant, fixed frequency variety. It is well known that the operating frequency of conventional resonant and similar free-running power supplies may vary dramatically as a function of luminous tube load (i.e. tube length) which, in turn, can result in decreased efficiency, supply non-starting, and an audible acoustic whine. Examples of known self-oscillating, free-running luminous tube power supplies includes U.S. Pat. Nos. 4,613,934 and 4,698,741.

Further, the transformer secondary windings required to generate the requisite luminous tube high voltage characteristically exhibit self resonances that fall close to, or within, the normal supply operating frequency range. Erratic and unpredictable supply performance can be expected where the supply is operated too close to such resonances. Thus, the present supply avoids these resonance-induced irregularities through the selection of an appropriate operating frequency—a frequency that remains substantially constant under all anticipated load conditions.

Although constant frequency luminous tube supplies are not new, known implementations have sacrificed both power (i.e. efficiency) and complexity (i.e. cost) to achieve the desired benefits of constant frequency operation.

Typically such supplies have employed a variable pulse width modulation (PWM) scheme in which the supply output current is regulated by varying the duration of a current pulse through the transformer primary winding. These current pulses are in turn gated by a PWM controller often of the integrated circuit variety.

Although PWM overcomes certain of the previously described problems of variable frequency, free-running supplies, conventional PWM systems have required significant circuitry including error amplifiers, ramp generators, flip-flop memory elements and voltage regulators. These elements all require electrical power. The Unitrode UC3843 PWM integrated circuit, for example, requires between 15–25 milliamperes at DC operating voltages of between 10–20 volts.

It is not this higher current, alone, that makes conventional PWM inefficient. Rather, it is the absence of a relatively low voltage DC supply to operate the PWM circuitry that presents the difficulty. In this connection, it will be noted that ordinary integrated circuits typically operate from a low voltage supply typically between 3–30 volts. The only and ultimate source of energy for luminous tube supplies is the 120 volt AC mains to which the supply is connected.

Several techniques for generating this low voltage are known including the incorporation of (1) a separate low voltage transformer, rectifier and regulator; (2) adding a third low voltage winding to the high voltage transformer; or, (3) a down-converter from the higher voltages available from the input line. Each of these solutions have their corresponding problems. Adding a winding to a transformer adds costs. Further, the PWM circuitry requires voltage which, in turn, is generated by the PWM circuit. In short, a start-up mechanism or voltage source must be provided.

Adding a separate low voltage transformer and supply is both bulky and, most importantly, expensive. And the final alternative, down converting or regulating from the line, requires either complicated and expensive switching convertors or series-pass regulation—the latter dissipating substantial amounts of unused energy in view of the PWM integrated circuit power requirements.

The present supply employs a unique "uniform pulse width" pulse width modulator in which substantially the only circuitry required is a constant frequency uniform pulse width generator or oscillator. In this connection any number of low current solutions are available including the extremely low power CMOS version of the ubiquitous 555 integrated timer. The power requirements of this device are so low that the very simple and economical series resistance, shunt zener style regulator performs admirably and without significantly lowering the overall efficiency of the luminous tube supply.

The 555 generates a periodic and constant stream of narrow pulses which, in turn, are coupled to the gate of, thereby switching "on", a power switching FET. More specifically, the 555 pulses, although of narrow width, are sufficient to charge the FET gate capacitance thereby assuring continued FET conduction after pulse cessation. The modulation of the pulse width, as required to facilitate output current regulation, is achieved through a current sense/compensation network which rapidly discharges the gate capacitance upon reaching the desired current/voltage point. In this manner a highly reliable, while elegant in its simplicity and low cost, luminous tube supply has been developed.

The advantages of and problems overcome by this supply, however, are not limited to those set forth above. For example, another problem associated with luminous tube power supplies intended to accommodate varying sign configurations is that of proper illumination intensity.

It is well known that the intensity of a luminous sign is generally related to its average gas current therethrough and, further, that the voltage required across the tube to generate such current is directly proportional to tube length. It will be appreciated that signs come in a variety of overall sizes and design complexities and consequently the amount, i.e. length, of luminous tube required will correspondingly vary from one application to another.

It is an objective of the present invention to provide, for each model power supply, the greatest range and flexibility with respect to the luminous tubes lengths that can be accommodated thereby to achieve the further economic advantages of quantity production through the minimization of inventory costs associated with stocking multiple components at the OEM part acquisition level and multiple models at the distribution level.

In this connection, one problem associated with conventional current mode regulated high voltage supplies, particularly of the constant frequency variety, is the observable decrease in tube illumination intensity as shorter tube lengths are adopted. This phenomenon has been traced to a corresponding decrease in average tube current—the average current required to effect full and proper illumination being generally constant and independent of overall tube length. It is the operating voltage across the tube that varies according to tube length.

The luminous supply of the present invention provides a substantially uniform average current without regard to the length of luminous tube utilized thereby facilitating adoption of a single model supply suitable for all normal sign configurations.

Although conventional current mode power supplies are regulated, the mode of regulation, as the name implies, is peak current regulation. Typically the high voltage transformer primary current is sampled with the width of each pulse being adjusted such that a predetermined peak current results.

However, as progressively shorter tubes are connected to such supplies, correspondingly lower load impedances, in particular inductances, are reflected back to the transformer primary which, in turn, causes the primary current to reach its predetermined trigger level more quickly. Thus, although the same maximum tube current is achieved, the average current is seen to decrease as a function of shortened tube length.

This problem has been virtually eliminated in the present supply through the use of an inexpensive but effective resistor/capacitor load current compensator. Importantly, this network, although operating at a substantially constant frequency independent of tube length, nevertheless serves to equalize the area under the respective current envelopes thereby forcing corresponding equal average tube currents. In this manner uniform tube illumination without regard to tube length is achieved.

Yet another problem encountered in luminous tube signage relates to the use of differing tube gases. Although neon is commonly employed in such signs, it will be appreciated that other gases, most notably mercury, are frequently employed where differing tube colors are required. Neon, for example, is known to produce the warmer tones including shades of red, orange, pink, and purple while mercury is preferred for the cooler spectral colors of blue, turquoise, white, or yellow. Mercury is particularly suited to coloration through the use of phosphors on the tubular glass envelop.

As detailed hereinafter, the use of certain gases, in particular mercury, in luminous signage creates special problems for which the present power supply is particularly adapted to solve. One such problem is the blackening of the tube ends, i.e. adjacent the electrode, after sustained luminous tube operation. The problem has become particularly acute with the recent substitution of high frequency power supplies for the conventional 60 Hz power transformer.

In this connection it has been discovered that the application of an asymmetrical waveform to a mercury luminous tube—a not-uncommon occurrence with conventional high frequency luminous tube power supplies—results in a cataphoresis effect whereby positive ions are seen to migrate in a correspondingly asymmetric manner.

Mercury and neon differ in one important respect—mercury has a significantly higher vaporization temperature which permits mercury to remain in the liquid state under ordinary room temperature conditions. Thus, unlike neon, where normal Brownian motion assures the migration of neutralized gas ions thereby assuring substantially uniform gas distribution throughout the tubular glass envelope, mercury can condense on the envelope—discoloring the envelop and depleting the uniform distribution and availability of mercury gas molecules throughout the tube.

It has been determined that the above-described deleterious effects of mercury-filled luminous tubes can be alleviated by averaging, on a direct current basis, the waveform asymmetry even though the resulting waveforms retain their overall non-symmetrical character. To this end, capacitance is placed in the power supply output which, as presently understood balances the output waveform but, in any event, has been found to dramatically reduce the long-experienced problem of mercury tube blackening.

Yet another feature of the present invention is its inexpensive, yet improved, ground fault safety system. Ground fault detectors have become an important and mandated tool for the minimization of shock or electrocution occasioned by the inadvertent contact with electrical circuitry, in the present case, luminous tube signage. Ground fault detectors seek to measure and limit 'unauthorized' currents to ground. Such currents are considered to be 'unauthorized' in the sense that ground currents should not exist under normal equipment operating conditions and, further, that the mostly likely path for a lethal current would be to ground.

Ground fault detection operates on the principle of measuring any imbalance between the respective power source lines—any inequality therebetween defining an otherwise unaccounted for 'missing' or ground fault current. Ground fault detectors are not new to the luminous tube power supply field, for example, U.S. Pat. No. 4,613,934. The present arrangement, however, provides for improved and more accurate ground fault detection, all for lower cost.

The detector described in the above-noted '934 patent employs the well-known method illustrated in FIG. 4 in which a current transformer is placed in the ground return path from the center-tap of the high voltage transformer secondary. In the absence of any unscheduled ground fault currents, the secondary winding current will be balanced with negligible current through the center-tap and current transformer. Should a ground fault condition exist, however, the '934 patent describes a single peak detector that triggers a ground fault alert/shut-down upon a current excursion exceeding a predetermined maximum safe limit. The '934 is sensitive, however, only to single polarity current excursions.

The present ground fault detector does not require, in the first instance, a specially wound, center-tapped transformer. In this connection it should be noted that the requirement for an additional tap in any high voltage winding requires special care to avoid inter-winding and winding-to-core shorts. Center-tapped transformer are correspondingly more expensive. Rather, the present ground fault detector employs capacitive center-tapping. Such center-tapping, however, is achieved through the use of the intrinsic secondary intra-winding capacitances, in particular, the distributed winding capacitances to the transformer core. By winding a symmetric secondary (i.e. with respect to the core), the core itself becomes the capacitive center, or center-tap, of the transformer thereby obviating any need, not only for the previously noted inductance winding center-tap, but for external capacitors as well.

As discussed, conventional luminous tube ground fault detectors such as disclosed in the '934 patent employ a single polarity peak current detector arrangement—this upon the faulty assumption that such currents are symmetrical. Although ground fault currents are AC, it has been observed that such currents are seldom symmetrical. Thus, the corresponding positive and negative peak amplitudes are rarely equal, sometimes differing by a factor of five to one. The difficulty associated with the unipolarity detection arrangement of the '934 patent is (1) the varying ground fault sensitivity from one ostensibly identical unit to another; (2) the inability to obtain repeatable ground fault interruption by any given unit under successively induced faults of constant magnitude; and, (3) the varying ground fault sensitivity from one supply lead compared to the other.

The above problems have been significantly reduced or eliminated in the present luminous tube supply through the use of a dual peak detector in which both positive and negative ground fault current peaks are detected and summed to provide a composite detection voltage. In this manner variations between respective polarity peaks are neutralized with the resultant detected ground fault signal being closely and repeatably related to the actual exigent ground fault current.

Other advantages and objects of the present invention in addition to those already discussed are set forth in, or will become apparent from, the drawings and the detailed description of the invention herein.

BRIEF DESCRIPTION OF THE DRAWINGS

FIG. 4 is a schematic/block representation of a prior art ground fault detector used in luminous power supplies illustrating an inductive center tap;

FIG. 5 is a schematic representation of a capacitive center tap arrangement;

FIG. 6 is a waveform diagram illustrating the current through two differing lengths of luminous tubes employing the load current compensator of the power supply of FIG. 1; and FIG. 7 is a waveform diagram illustrating the current through two differing lengths of luminous tubes without the load current compensator of the power supply of FIG. 1.

DESCRIPTION OF THE PREFERRED EMBODIMENT

Figure 1:
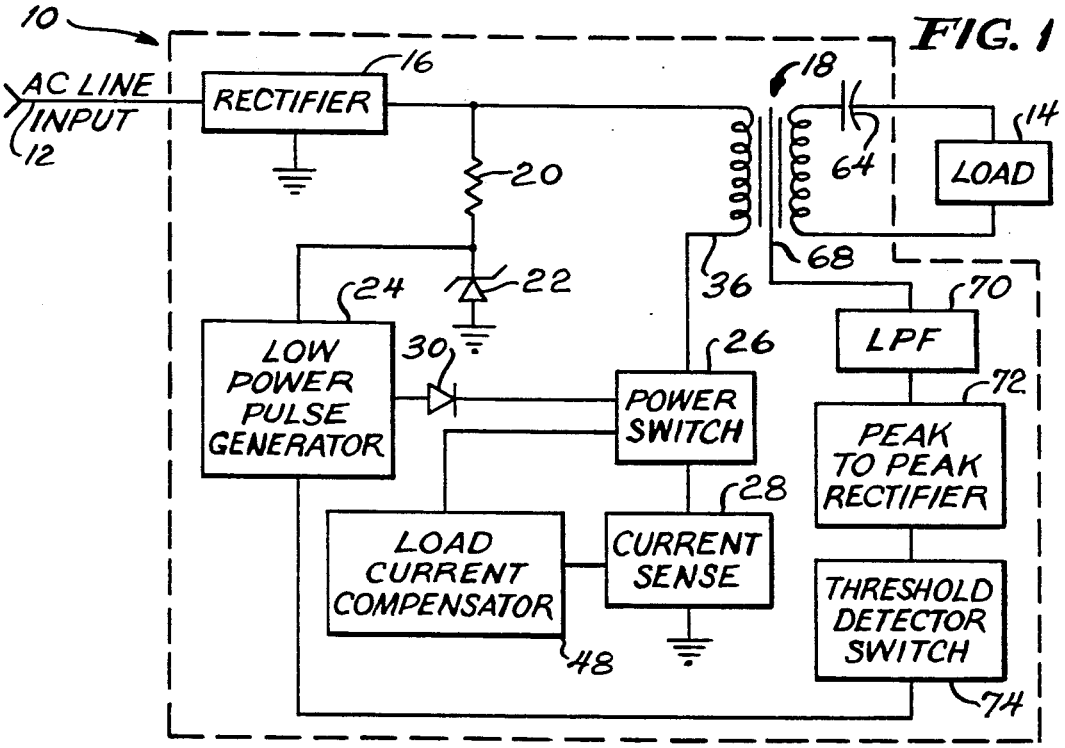
FIG. 1 is a block representation of the luminous tube power supply of the present invention.

FIG. 1 illustrates the luminous tube power supply 10 of the present invention shown connected to a source of line power at 12 (typically 120 VAC, 60 Hz) and to a luminous tube load 14. Load 14 may be of neon, mercury or any other suitable ionizable gas or gas mixture.

The length of the luminous tube load is chosen according to the requirements of the specific sign design. It is a significant feature of the present invention that luminous tubes of virtually any practical length may be connected to the supply without the requirement for adjustments or multiple power supply models. In this latter connection, the length limits on luminous tubes runs between about one foot to thirty feet. The shorter length limit is dictated by the economies of size (i.e. alternative lower cost technologies are available for shorter tube lengths) while the corona inception potential for air creates the above-noted upper limit.

Corona is the nemesis of virtually all high voltage circuits operating in non-vacuum environments. For the older 60 Hz transformer power sources the corona inception potential (in air) is approximately 15,000. The inception potential, however, drops to about 9,000 volts at the higher operating frequencies, e.g. 20 KHz, of the present invention. To avoid significant corona problems, operation below the inception potential is recommended. Nine thousand volts is generally equivalent to the noted 30' length limit. For longer signage length requirements, multiple power supplies represent the better solution.

Line input 12 interfaces to a conventional full wave bridge rectifier 16 thereby providing a DC output of approximately 160 volts for operation of the low power pulse width modulation and ground fault circuitry. This DC voltage is also gated to the primary of high voltage transformer 18, as detailed below, thereby serving as the ultimate source of power to the luminous tube 14.

Power to operate the pulse width modulator circuitry is provided, as noted, from the 160 volt output of rectifier 16. As this circuitry is preferably operated from a substantially lower voltage source, e.g. 16 volts, an inexpensive zener regulator comprising a series resistor 20, typically about 68K ohm, and shunt zener 22, e.g. 1N4745, is provided. It will be appreciated that this regulation arrangement is both simple and inexpensive in construction and, importantly, of extremely low power consumption, drawing only about 2 milliamperes from the 160 volt supply. It will be observed that this low voltage is generated without resort to the inclusion of low voltage power transformers or more complex switching regulators, and that the dissipation in series resistor 20 is less than $\frac{1}{3}$ watt.

The ability to implement such an efficient and low cost power supply is traceable to the present modified pulse width modulation (MPWM) arrangement in which a constant frequency and constant pulse width oscillator 24 of extremely low power consumption is utilized. In this connection as noted, pulse generator 24 is not, itself, a pulse width modulator, rather, it is a simple generator of a periodic stream of pulses of uniform width. The complexities of PWM have largely been eliminated with the pulse modulation function being subsumed as outlined below in the power switch 26 and current sense 28 functions.

In this manner, the pulse generator 24 may be of limited complexity resulting in power and cost savings both with respect to this generation function and, as described above, in its associated low voltage power supply. Pulse generator 24 may be, for example, a low power CMOS version of the 555 timer configured to self-oscillate at about 20 KHz to produce a corresponding series of narrow pulses, preferably of one microsecond or less in duration.

The constant width pulses from generator 24 are coupled through a silicon diode 30 to power switch 26 which is preferably an insulated gate power FET 32

(FIG. 2), for example a International Rectifier IRF830. More specifically, these pulses serve to charge the gate-to-substrate capacitance 34 of the FET (typically 1000 pf), in turn, virtually instantaneously switching the FET "on".

Figure 2:
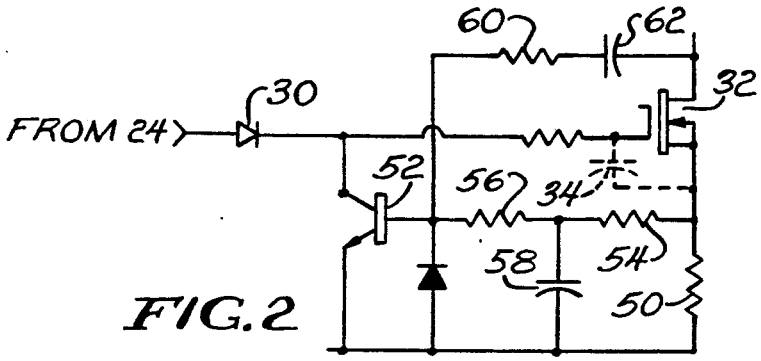
FIG. 2 is a schematic diagram of the pulse width modulation portion of the power supply of FIG. 1 including the power switch, current sense, and load current compensation functions.

It will be understood that capacitor 34, depicted in dotted form in FIG. 2, represents the intrinsic gate capacitance of FET 32 and consequently that additional external capacitance is not required under ordinarily circumstances. The gate input of the FET exhibits extremely low conductance and consequently this gate capacitance will remain charged indefinitely—absent its deliberate discharge—long after cessation of the short charging 1 μs pulse.

Switching the power FET 32 into conduction effectively grounds the cold-side 36 of transformer 18 thereby placing the full 160 volt DC output from rectifier 16 across the transformer primary. This occurs at periodic intervals, as illustrated in FIGS. 6 and 7 at times $t_n$ and $t_{n+1}$, more specifically, every 50 μs for a pulse generator frequency of 20 KHz.

However, due to the effective inductance in the transformer primary, the current therethrough cannot instantaneously change. Rather, it increases as the time integral of the fixed voltage across the primary, in the present case a constant DC potential of 160 volts, thereby linearly increasing, again, as shown in FIGS. 6 and 7. The rate of increase of the primary current is inversely proportional to the effective primary impedance, in particular, its inductance. As luminous tubes of decreasing length are connected to the present supply 10 (i.e. the tubes of decreasing impedance), the effective primary inductance correspondingly drops. Thus the current waveforms 40 and 42 of respective FIGS. 6 and 7 represent the power supply operation with luminous tube loads of comparatively shorter length than the corresponding current waveforms 44 and 46.

The current in the transformer primary continues to increase until a predetermined threshold current is reached, at which moment the load current compensator 48 (FIG. 1) grounds the gate input of the FET 32 thereby discharging the gate capacitance and switching the FET "off". Turn-off is shown in FIGS. 6 and 7 at times $t'_n$ and $t'_{n+1}$. In this connection it should be observed that the duration of the enabling pulses from generator 24 (e.g. 1 μs) are comparatively shorter than the "on" periods of the FET (e.g. 2–25 μs) and consequently the FET cannot again be switched into conduction until the next generator enabling pulse. In this manner, the actual "on" pulse width of the FET is modulated although being initially gated by a constant pulse width generator 24.

Referring to FIGS. 1 and 2, current sensing 28 may advantageously be performed by placing a resistance 50, e.g. 0.15 ohm, in the series with the FET source ground return. Thus, the voltage across this resistor directly tracks, and linearly increases with, the FET current. Current sense resistor 50 is connected across the base-emitter junction of a small-signal NPN switching transistor 52 (e.g. 2N4401) through the load current compensator 48 comprising resistors 54,56 and capacitor 58. Resistor/capacitor combination 54,58 defines a relatively short time constant between about 0.1 and 20 μs (1.5 μs preferred) suitable for averaging the luminous tube currents.

In the absence of the load current compensator 48, the FET current will linearly rise until the voltage across resistor 50 reaches the silicon base-emitter junction potential of transistor 52 (approximately 0.6 volts) at which instant this transistor will conduct thereby grounding the FET gate and discharging the gate capacitance 34. A Schmidt-trigger type positive feedback network comprising the series connected resistor 60 and capacitor 62 is provided to assure rapid and complete turn-off of FET 32.

FIG. 7 illustrates the above-described operation for, respectively, shorter (at 42) and longer (at 46) luminous tubes. It will be observed that the maximum positive FET current, in turn the current throught the luminous tube, is independent of the rate-of-change of the current or its overall duration. This is due to the inherent limitation of conventional current mode regulators that respond to the absolute or peak current.

It will be appreciated that the overall light output of the luminous tube load 14 is proportional to the time-average current therethrough. Referring again to FIG. 7, it will be apparent that the time-average current is greater for the longer length tube 46 than the shorter tube 42. Thus, the illumination intensity for the arrangement depicted varies considerably as a function of tube length.

FIG. 6, by contrast, illustrates the respective short 40 and long 44 tube current waveforms employing the load current compensator 48 of the present invention. It will be observed that while the short tube current 40 reaches a higher maximum value, its pulse duration is comparatively shorter than that of the long tube 44. In fact, the average tube currents, as reflected by the areas under the respective waveforms, are nearly equal thereby assuring more uniform tube illumination intensity without regard to tube length.

A capacitor 64 having a low reactance at the operating frequency of the supply (typically 1000 pf–0.01 μf) is placed in series with the secondary high voltage transformer output winding which, in turn, places this capacitance in series with the output luminous tube load 14. As discussed above, this capacitance serves to eliminate or substantially reduce luminous tube discoloration or blackening, particularly in the electrode regions of mercury gas tubes.

Figure 3:
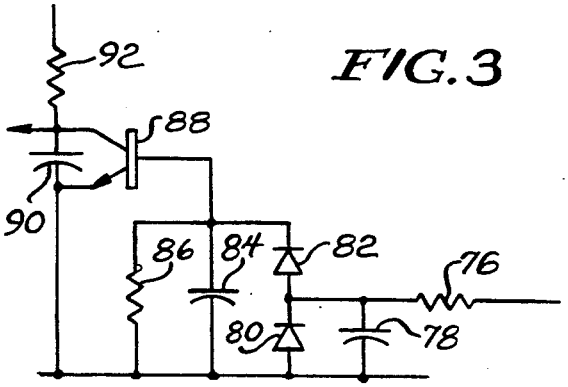
FIG. 3 is a schematic diagram of the ground fault portion of the power supply of FIG. 1 including the low pass filter, dual-peak detector, and threshold switch.

The ground fault protection system of the present invention is best depicted in FIGS. 1 and 3 with FIG. 5 illustrating a capacitive center-tap arrangement which forms the theoretical starting point therefor. It will be noted, however, that the present detector does not require external or extrinsic capacitors such as shown at 66 in FIG. 5. Rather, the intrinsic distributed capacity between the secondary winding and the transformer core serves as the required capacitive center-tap.

The ground fault signal from the transformer core center-tap 68 is low pass filtered, at 68, to remove transient or higher frequency signals prior to dual-peak rectification and detection 72 and 74, respectively. The output of detector 74 is, in turn, connected to the pulse generator 24 whereby pulse generation is inhibited whenever the a ground fault current exceeding a predetermined limit is detected.

FIG. 3 best illustrates the details of the above-described ground fault circuitry. A single-pole low pass filter 70 is formed by series resistor 76 and shunt capacitor 78. A corner frequency of between about 5–500 Hz has been found satisfactory. The dual-peak detector comprises a pair of series connected silicon diodes 80,82, e.g. 1N4148, and a filter/timing network including shunt capacitor 84 and resistor 86. Diodes 80,82 respectively detect opposed polarity ground fault currents which, in turn, are summed by capacitor 84. Transistor 88 inhibits further pulse generation when the a threshold ground fault current has been detected. This threshold sensitivity may be adjusted by varying the time constant defined by the capacitor/resistor combination 84,86. Typical values for these components are 0.022 μf and 220 Kohms. Capacitor 90 and resistor 92 define a ground fault inhibit timer, typically about 1 second duration, which precludes immediate power supply restarting upon a valid ground fault trip-out condition.

I claim:

1. A high frequency power supply for luminous gas tubes including a step-up transformer having a high voltage secondary for operative connection to a luminous gas tube load and a low voltage primary; means for generating a dc voltage; solid-state switch means responsive to first enable and second disable signals to thereby switch between first electrically closed and second electrically open conditions; means for sensing the current through the transformer primary; the transformer primary, switch means, and current sense means being series connected across the dc voltage generating means whereby substantially all of said dc voltage is impressed across the transformer primary in response to the switch means enable signal; pulse means for generating a periodic substantially constant frequency stream of uniform width narrow pulses, said pulses defining the switch means first enabling signal; the current sense means generating the switch means second disabling signal in response to a predetermined current profile through the primary whereby said switch means is switched to the second open condition thereby controlling the width of the current pulse such that the primary current does not exceed said predetermined profile.

2. A high frequency power supply for luminous gas tubes including a step-up transformer having a high voltage secondary for operative connection to a luminous gas tube load and a low voltage primary; means for generating a dc voltage; an FET switch in series with the transformer primary across the dc generating means whereby substantially all of the dc voltage is impressed across the primary in response to an enabling signal on the gate of the FET switch which signal switches the FET into conduction; pulse means for generating a periodic substantially constant frequency stream of uniform width narrow pulses, said pulses operatively connected to the FET gate, each pulse charging the intrinsic gate capacitance of the FET thereby forming the FET enabling signal and switching the FET into conduction, the FET switch remaining in conduction until said intrinsic gate capacitance is discharged; means for sensing the current through the transformer primary; means operatively connected to the current sensing means and to the FET gate for discharging the FET gate capacitance when a predetermined FET current profile is attained thereby switching the FET into non-conduction and terminating further current flow through the transformer primary.

3. The high frequency power supply for luminous tubes of claim 2 in which the means for discharging the FET gate capacitance includes luminous tube current control means whereby the FET gate capacitance is discharged in response to a predetermined average current through a luminous tube load thereby assuring that all such loads shall be illuminated at substantially the same intensity per unit length regardless of overall tube length.

4. The high frequency power supply for luminous tubes of claim 3 in which luminous tube current control means includes a single pole averaging network.

5. The high frequency power supply for luminous tubes of claim 4 in which in which the averaging network has a time constant between about 0.1 and 20 μs.

6. The high frequency power supply for luminous tubes of claim 2 in which the pulse generating means is a very low power oscillator and including low power regulator means for supplying a source of low voltage to said pulse generating means whereby the width of the transformer primary pulses may be modulated as required for proper luminous tube illumination with a minimum of energy lost in the pulse generating function.

7. A high frequency power supply for luminous gas tubes including a step-up transformer having a high voltage secondary for operative connection to a luminous gas tube load and a low voltage primary, said transformer primary and secondary being wound on a core; means for applying current pulses to the primary; means for controlling the primary current pulses to provide for a predetermined luminous tube current; means for disabling the current pulse applying means; ground fault current sensing means operatively connected to the pulse disabling means whereby the current pulses to the primary are interrupted upon detection of a predetermined ground fault current; the current sensing means including a connection to the transformer core whereby the intrinsic capacitance between the transformer secondary and the core places the core in a generally capacitive center-tap relationship with respect to the secondary.

8. A high frequency power supply for luminous gas tubes including a step-up transformer having a high voltage secondary for operative connection to a luminous gas tube load and a low voltage primary; means for applying current pulses to the primary; means for controlling the primary current pulses to provide for a predetermined luminous tube current; means for disabling the current pulse applying means; ground fault current sensing means operatively connected to the pulse disabling means whereby the current pulses to the primary are interrupted upon detection of a predetermined ground fault current; the current sensing means including means for detecting first positive and second negative ground fault currents and summing means for generating a composite signal from said first and second ground fault currents, the disabling means being operatively connected to the summing means and responsive to said composite signal whereby improved ground fault accuracy and reliability results.

* * * * *